United States Patent [19]

Bavoux et al.

[11] Patent Number: 4,532,863

[45] Date of Patent: Aug. 6, 1985

[54] METHOD AND APPARATUS FOR CONTROLLING THE TEMPERATURE IN ROTATING PRINTERS

[75] Inventors: Guy Bavoux, Coye la Foret; Arthur B. Dallaserra, Aulnay Sous Bois, both of France

[73] Assignee: Herve Et Fils, S.A., Paris, France

[21] Appl. No.: 441,676

[22] Filed: Nov. 15, 1982

[30] Foreign Application Priority Data

Jan. 26, 1982 [FR] France ..... 82 01190

[51] Int. Cl.[3] ..... B41F 9/06

[52] U.S. Cl. ..... 101/153; 101/150; 101/170; 101/411 A; 118/64

[58] Field of Search ..... 101/153, 157, 416 R, 101/416 A, 150, 152, 416 B, 426, 170; 34/121, 191; 118/58, 64, 65; 100/93 RP; 162/206, 207, 224, 226, 290, 375

[56] References Cited

U.S. PATENT DOCUMENTS

| | | | |
|---|---|---|---|
| 2,115,725 | 5/1938 | Koch | 101/157 |
| 2,295,080 | 9/1942 | Gruppe | 101/157 |
| 2,333,172 | 11/1943 | Gruppe | 101/157 |
| 2,579,181 | 12/1951 | Faeber | 101/157 |
| 2,676,538 | 4/1954 | Bamford . | |
| 3,067,056 | 12/1962 | Remer | 101/153 |
| 3,094,066 | 6/1963 | Kendrick . | |

FOREIGN PATENT DOCUMENTS

| | | |
|---|---|---|
| 652713 | 10/1937 | Fed. Rep. of Germany . |
| 1953590 | 6/1971 | Fed. Rep. of Germany . |
| 2328252 | 1/1974 | Fed. Rep. of Germany . |
| 810011 | 3/1937 | France . |
| 545336 | 5/1942 | United Kingdom . |
| 589402 | 6/1947 | United Kingdom . |

*Primary Examiner*—Edgar S. Burr
*Assistant Examiner*—David A. Wiecking
*Attorney, Agent, or Firm*—Sandler & Greenblum

[57] ABSTRACT

The invention concerns a rotating printing device and process for transferring a product from an engraved printing cylinder to a continuously moving web. A press or presser roller is adapted to provide a contact zone with the web and to apply the contact zone against the printing cylinder during the transfer of the product to the web. The device includes an enclosure adapted to enclose both the contact zone and a container for containing the product. Gas flow means are included for providing a flow of temperature controlled gas so as the temperature of the contact zone and the temperature in the product container at substantially equal. The process includes the step of flowing a gas in the enclosure to substantially equalize temperature of the contact zone and in the product container.

17 Claims, 1 Drawing Figure

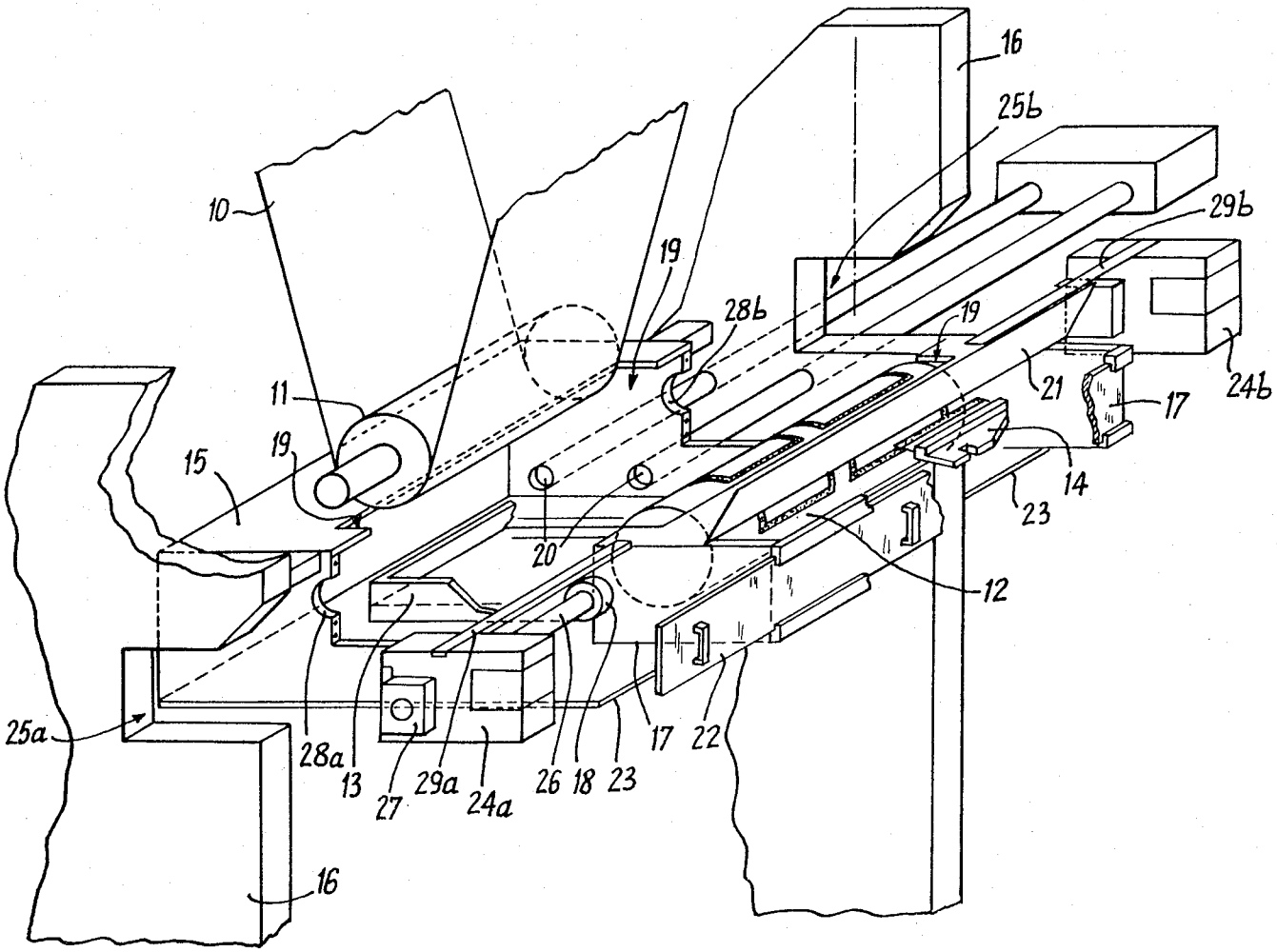
10
11
12
13
14
15
16
17
18
19
20
21
22
23
24a
24b
25a
25b
26
27
28a
28b
29a
29b

METHOD AND APPARATUS FOR CONTROLLING THE TEMPERATURE IN ROTATING PRINTERS

BACKGROUND OF THE INVENTION

1. Field of the Invention

The invention relates to a rotating printing device and process for printing on a web which is continuously fed off of a reel.

2. Description of Prior Art

Rotating printing processes, such as rotogravure, are well known and are used to reproduce drawings and various graphical illustrations and the like. Typically, the desired illustration is engraved on the cylindrical form of a printing cylinder coated with a product, such as a printing liquid, which is transferred onto a moving and continuous web of suitable material as the printing cylinder rotates. Such processes may further be used to provide flat coatings.

The cylindrical forms of the printing cylinders can be intaglio engraved (heliograph) or be engraved in relief (typography, flexograph). The printing or the coating of the web can be achieved by means of various products which are suitable to achieve the desired results, e.g., printing inks, carbons, self-adhesives, thermo-fusible glues, chemical coatings for self-reproductive papers, i.e., carbon paper and pressure sensitive paper, or for papers known as "chemical" papers, etc.

The product is transferred onto the web from a product container in which a rotating cylinder is submerged. The rotating cylinder can be a printing cylinder which is intaglio engraved (heliograph) or a takeup cylinder coating the forms in relief carried by a cliche-carrying cylinder by means of a touching cylinder (typography, flexography). The product, remaining in the grooves of the intaglio engraved printing cylinder after wiping of the engraved cylinder by means of a wiper supported along one of its edges, is deposited on the web which, at the end of the procedure, is placed in intimate contact with the engraved printing cylinder. For typography or flexography, the raised portions of the printing cylinder are coated and the product transferred to the web in the same manner as in heliography. In each case, a contact zone is formed between the web and a press or press roller, coated with rubber and subjected to pressure of a hydraulic or mechanical nature, which presses the web against the product coated printing cylinder thereby transferring the product to the web.

So that the product exhibits satisfactory physical and/or chemical characteristics, it is often necessary to determine and impose a very precise temperature at the moment of deposition on the web. This is the case particularly for carbons, thermo-fusible glues, and the emitting and receiving coatings of chemical paper. The cold viscosity of the product can, furthermore, necessitate a heating during the storage of the product in the container and during the entire transfer procedure (this is particularly true of thermo-fusible glues).

In all cases, too sudden variations of temperature of the product can cause irreversible modification of the product. This is of particular importance in the course of the transfer of the product, i.e., during the period where the product is subjected to the differing temperatures of various roller and feed arrangements.

It has thus been proposed to maintain the temperature of the product storage container, the cylindrical form of the printing cylinder, the press roller and each of the complementary product modifying or preparing elements of the cylindrical form, such as the wiping blades for heliogravure or the takeup cylinder and touching cylinder for typography or flexography. However, this feature is accomplished by thermostatic regulation of each of the elements independently of one another by means of oil baths and heating sticks. This solution is not very satisfactory, because of the high consumption of energy due to a significant loss of heat into the ambient air. Additionally, disadvantages are experienced because one does not totally overcome the variations of temperature from one element to another due to the dispersion and the conduction of heat from one element to another.

A rotating printing device comprises an enclosure containing a printing cylinder. The enclosure includes the window and the device also incorporates a press which is adapted to support a web on which a product is to be applied. The window allows passage of at least a portion of the press into the enclosure and the press is adapted to form a contact zone with the web and to apply the contact zone against the printing cylinder. A container is adapted to contain the product for application to the printing cylinder and is enclosed by the enclosure. Gas flow means are included for providing a flow of gas having a predetermined temperature in the enclosure. The contact zone is positioned within the flow of gas such that the temperature within the product container and the temperature of the contact zone are substantially equal.

The process for temperature control is provided which uses a rotating printing device including an enclosure containing a printing cylinder. The enclosure encloses at least a portion of the press in which a product is to be applied. The press is adapted to provide a contact zone between the web and the printing cylinder, which is supplied with product from a container which is also enclosed by the enclosure. The process comprises the step of forming a flow of gas at a predetermined temperature in the enclosure to maintain the temperature of the contact zone as well as the product of the container at substantially the same temperature.

SUMMARY OF THE INVENTION

The invention provides a rotating printing device and process which assures a substantially perfect equality between the temperatures in the product container and on the surface of each active element including the contact zone of the pressure roller and as the web surface which is presented during the printing position. This latter point is very important in assuring the homogeneity of the deposit, over its entire thickness.

According to the invention the rotating printing device comprises an enclosure which encloses the product container, the engraved printing cylinder and complementary elements and which is constituted by two separable portions connected in a substantially sealed manner. The enclosure includes a fixed portion integral with the frame of the rotating printing device which receives means for feeding the product, means for controlling the level and circulation of the product as well as means for adjustment of the container height. A movable portion of the enclosure carries bearings in which the engraved form of the printing cylinder and the complementary elements rotate. A window, provided on the upper surface of the enclosure, allows for the passage of the lower portion of the press or pressure roller. The apparatus is provided with at least one pulsed air inlet having a controlled temperature, the inlet being positioned at the lower portion of the fixed portion of the enclosure.

According to the process of the present invention, all of the active elements of the rotating printing device are in the path of the same current of air which has a controlled temperature and all elements are maintained at the same temperature. Thus, the pressure cylinder and the web portion in the printing position are placed in the window and are licked and/or contacted by the air flow escaping towards the exterior.

According to the present invention, it is possible to print or coat at a precise predetermined temperature which may even be relatively elevated, i.e., up to 150° C. and above. However, the enclosure likewise has substantial advantages in cold coating techniques, for example, for coatings of self-adhesives, which utilize a volatile solvent for the product, because the limited volume of the enclosure makes it possible to rapidly saturate the atmosphere, which assumes the stability of the product.

After the volatile solvent has saturated the atmosphere within the enclosure, the enclosure is then evacuated after a predetermined time period.

The enclosure further provides protection against damage by involuntary contact in the course of operation. The enclosure further considerably reduces the odorous emissions (cold or hot) resulting from the evaporation of certain components of the product.

BRIEF DESCRIPTION OF THE DRAWINGS

The invention will now be described with reference to the annexed drawing in which:

The FIGURE illustrates by way of non-limiting example a heliographic press provided with the improvements according to the invention.

DESCRIPTION OF PREFERRED EMBODIMENTS

In the FIGURE the rotating printing device is shown with the two portions of the enclosure, generally indicated at A, separated. For greater clarity certain elements, which do not form a part of the invention, are not shown, such as the pivot axle of wiper 14, lifting and adjustment means of product container 13, the drive element of engraved printing cylinder 12 fitted on shaft 26, means for feeding and controlling the level and circulation of the product, etc.

As may be seen from the FIGURE, a rotating printing device is adapted to reproduce drawings, signs, or the like, engraved on a cylindrical form of printing cylinder 12. The desired illustration is reproduced on continuously moving thin web 10 by means of a product or printing fluid contained in container 13 which is transferred from printing cylinder 12 to web 10 by placing printing cylinder 12 in intimate contact with web 10. This intimate contact is accomplished with a press means, press or pressure roller 11, subjected to a hydraulic or mechanical pressure, which presses web 10 against cylinder 12 after printing cylinder 12 has been appropriately coated with the product. In the example shown (which is a heliographic press) cylinder 12 is intaglio engraved and is immersed directly in container 13. Excess product is removed from cylinder 12 by a complementary element in the form of wiping blade 14.

In the case of a product having a high viscosity, a complementary element other than wiper 14 may be used which is constituted by a ruler or distribution blade (not shown). This distribution blade is of the type disclosed in French patent application No. 81 24 026 which is copending herewith, in the name of the instant Applicant, the disclosure of which is hereby incorporated by refernece thereto.

It should be well understood that the rotating printing device can be typographic or flexographic in which case printing cylinder 12 is a cliche-carrying cylinder engraved in relief, which is not immersed in container 13 but is coated with the product by means of at least two complementary elements (not shown), i.e., a takeup cylinder immersed in container 13 and a touching cylinder transferring the product of the takeup cylinder to the reliefs of printing cylinder 12.

According to the present invention, enclosure A surrounds cylinder 12, the complementary elements (wiper 14 and possible distribution blade for heliography or takeup cylinder and touching cylinder for typography or flexography) and product container 13. Window 19, constituting a passage for the lower portion of press roller 11, is provided on the upper surface of enclosure A. Enclosure A is constituted by two separable portions which can be connected in a substantially sealed fashion, i.e., fixed portion 15 and movable portion 17. Fixed portion 15 is integral with frame 16 of the rotating printing device and carries means (not shown) for delivery, for level control and circulation of the product, as well as the means for height adjustment of container 13. Movable portion 17 carries bearings, such as at 18, on which rotate printing cylinder 12 and the complementary elements (here the wiper 14 whose pivot axle is not shown). At least one gas inlet 20 is provided near or at the base of fixed portion 15 for introducing a flow of gas or pulses of gas, for example air, at a controlled temperature.

Illustrated in the FIGURE by means of black boxes are device B for generating a pulse of gas having a predetermined temperature through the conduits which terminate at outlet port(s) 20, and means for controlling the temperature of the pulse of gas, as illustrated by black box C. Both the pulsing apparatus and temperature control device are conventional devices.

By spacing movable portion 17 from fixed portion 15, after having lowered container 13, one gains direct access to printing cylinder 12 to affect change. Furthermore, if adjustments are to be provided, in the course of operation, for the complementary elements as defined hereinabove, one obtains access to the adjustment controls for the complementary elements by openings which are provided with closure means such as pivot door 21 on the upper surface of portion 17 and/or sliding panel 22 on the front surface of portion 17.

In the example shown, the junction plane of fixed portion 15 and movable portion 17 passes through the axis of rotation of pressure roller 11. With the enclosure in the sealed operative position, the junction plane of portions 15 and 17 likewise passes through the axis of rotation of printing cylinder 12. Also, bearings 18, integral with movable portion 17, project towards the rear in the example illustrated.

On the lateral sides of fixed portion 15 cutouts **28*a* and 28*b* are provided in which the rear-facing portions of the bearings 18 are lodged. With this arrangement, window 19 of the upper surface of enclosure A is formed by two grooves facing one another which are, respectively, provided on the upper surfaces of each of fixed portion 15 and movable portion 17**.

Fixed portion 15 of enclosure A is a parallelpipedic case which opens upwardly and whose lower surface 23 has a portion which projects primarily downwardly so as to form a stop to block the movement of movable portion 17 which, in the example illustrated, assumes the form of a bottomless drawer having no rear surface.

Two carrying blocks or connection means 24*a* and 24*b* are, respectfully, provided on both sides of movable portion 17. Blocks 24*a* and 24*b* are connected to the movable portion 17 by axle 26 and printing cylinder 12 which may have, if desired, the axles of complementary elements (not shown) and linkage bars such as 29*a* and 29*b*.

In the operative position, carrier blocks 24*a* and 24*b* are fitted in openings 25*a* and 25*b* provided in jambs of frame 16 such that blocks 24*a* and 24*b* are firmly fixed or locked therewith. Axle 26 of printing cylinder 12 and the axles of the complementary elements can be rotationally driven via a drive train (not shown) through blocks 24*a* and 24*b*, and across bearings 27, which extend beyond frame 16 at least on one of the sides so as to receive the drive element.

Although not illustrated, wiper 14 can be adjusted relative to the printing cylinder in order to adjust the amount of excess product which is removed from the cylinder prior to contact of the cylinder with the web to be printed on.

Of course, modifications in form and detail can be provided to the general structure which has just been described without going beyond the scope of the invention particularly with respect to the openings for inspections and adjustments; the pulsed air inlets (which can be positioned on bottom 23 of fixed portion 15); the guidance means and embedding of carrier blocks 24*a* and 24*b*, etc.

When the product being applied necessitates operating at a temperature which is substantially different from the ambient temperature, all of the walls of the fixed and mobile portions of the enclosure are heated (including the closure means of the access openings such as 21 and 22).

The invention as disclosed in the instant application can be easily installed on existing presses as well as being fitted on new apparatus.

While the invention has been particularly shown and described with reference to preferred embodiments thereof, it will be understood by those skilled in the art that various changes in form and detail may be made therein without departing from the spirit and scope of the invention as defined by the appended claims.

What is claimed is:

1. A rotating printing device comprising:

(a) an enclosure containing a printing cylinder, said enclosure including a window;

(b) a pressure roller comprising means for supporting a web on which a product is to be applied, said window comprising means for allowing at least a portion of said pressure roller to pass into said enclosure simultaneously with at least a portion of said web, said pressure roller also comprising means for forming a contact zone with said web and means for applying said contact zone against said printing cylinders;

(c) a container comprising means for holding said product for application to said printing cylinder, said container being enclosed by said enclosure;

(d) gas flow means for providing a flow of gas at a controlled temperature to said enclosure, said contact zone being positioned in said flow of gas, said gas flow means comprising one gas conducting conduit having an inlet for pulsating air located in a lower portion of said enclosure, said inlet comprising means for conducting said controlled temperature gas flow into said enclosure, said gas flow means and said container together comprising means for maintaining the temperature within said product container and the temperature at said contact zone substantially equal.

2. A rotary printing device according to claim 1 wherein said enclosure comprises two separable portions adapted to be joined in a substantially sealed fashion.

3. A rotating printing device according to claim 2 wherein said gas inlet communicates with the interior of said enclosure, and wherein said gas flow means further comprises gas pulsing means for generating at least one pulse of gas at a controlled temperature and temperature control means for controlling the temperature of each said pulse of gas.

4. A rotating printing device according to claim 1 wherein said printing cylinder is of the heliographic type, said printing device further comprising product preparing means comprising wiping means for removing excess product from said printing cylinder prior to contact with the web to be printed on.

5. A rotating printing device according to claim 4 wherein said enclosure is a parallelepipedic chest and said two separable portions thereof further comprise:

(a) a fixed portion in the form of a parallelepipedic case which opens upwardly and includes a forwardly facing bottom surface which provides a stop; and (b) a movable portion having a top surface and a front surface which forms a bottomless drawer without a rear surface, said front surface being adapted to abut said stop of said fixed portion so as to position said separable portions in a sealed configuration.

6. A rotating printing device according to claim 5 wherein said front surface of said movable portion further comprises a closable opening.

7. A rotating printing device according to claim 5 wherein said movable portion of said enclosure further comprises connection means for attachment of said movable portion to a frame of said rotating printing device.

8. A rotating printing device according to claim 7 further comprising drive train means for connecting said printing cylinder to a drive element, said drive train means being carried by at least one of said connection means.

9. A rotating printing device according to claim 8 wherein said application means comprises a transfer roller adapted to be immersed in product within said product container, said printing cylinders being engraved in relief.

10. A device in accordance with claim 1, said enclosure having an upper wall, said window being located in said wall.

11. A process for controlling the temperature of a rotating printing device including an enclosure containing a printing cylinder, the enclosure enclosing at least a portion of a pressure roller comprising means for placing pressure against a web on which a product is to be applied and to thereby form a contact zone between said web and said pressure roller, said pressure roller also comprising means for forming a contact zone with said web and for applying said contact zone against said printing cylinder, said printing cylinder being supplied with said product from a container which is also enclosed by said enclosure, said enclosure including a window, said process comprising passing said pressure roller and said web simultaneously into and out of said enclosure through said window and comprising conducting a gas flow at a controlled temperature through at least one conduit having an inlet which is located at a lower portion of said enclosure, and contacting said pressure cylinder and said web with said gas flow, thereby maintaining the temperature of said contact zone and said product within said container at substantially equal temperatures.

12. A process according to claim 11 wherein said gas is air.

13. A process according to claim 12 wherein said flow of gas is provided as a single pulse.

14. A process according to claim 12 wherein said flow of gas is formed as a series of pulses.

15. A process according to claim 11 wherein said predetermined temperature is in the range of about 150° C. and above.

16. A process according to claim 11 wherein said gas is a volatile solvent of said product.

17. A process according to claim 16 further comprising the step of evacuating said enclosure a predetermined time period after said volatile solvent has saturated the atmosphere contained within said enclosure.

* * * * *

UNITED STATES PATENT AND TRADEMARK OFFICE

CERTIFICATE OF CORRECTION

PATENT NO. : 4,532,863

DATED : August 6, 1985

INVENTOR(S) : Guy BAVOUX and Arthur B. Dallaserra

It is certified that error appears in the above-identified patent and that said Letters Patent is hereby corrected as shown below:

At column 1, line 42, insert ---is--- before "transferred";

At column 4, line 5, change "refernece" to ---reference---;

At column 4, line 46, change "affect" to ---effect---;

At column 5, line 1, change "parallelpipedic" to ---parallelepipedic---;

At column 6, line 56, change "cylinders" to ---cylinder---; and

At column 6, line 58, insert ---rotating printing--- before "device".

Signed and Sealed this

*Eighth* Day of *April 1986*

[SEAL]

*Attest:*

DONALD J. QUIGG

*Attesting Officer*

*Commissioner of Patents and Trademarks*